United States Patent [19]

Pirro

[11] 4,390,110

[45] Jun. 28, 1983

[54] HANDLE INTERLOCK FOR A TRASH CAN LID

[75] Inventor: Armand Pirro, Leominster, Mass.

[73] Assignee: Cosco, Inc. (Tucker Housewares Div.), Leominster, Mass.

[21] Appl. No.: 370,679

[22] Filed: Apr. 22, 1982

[51] Int. Cl.[3] ..... B65D 45/00

[52] U.S. Cl. ..... 220/318; 220/306; 220/1 T

[58] Field of Search ..... 220/318, 306, 1 T, 94 A

[56] References Cited

U.S. PATENT DOCUMENTS 3,471,054 10/1969 Ostrowsky et al. ..... 220/318

3,741,433 6/1973 Bentley et al. ..... 220/318

3,840,152 10/1974 Hodge ..... 220/318

4,351,447 9/1982 Eraff ..... 220/306

*Primary Examiner*—George T. Hall

*Attorney, Agent, or Firm*—Charles R. Fay

[57] ABSTRACT

A lid for a plastic trash can having interlocking structures therewith at diametrically opposite sides thereof, each said structure including an inverted rim on both lid and can, a handle spaced from the container but integral therewith, and a pair of spaced vertical walls for each handle, a slot in each wall, the rim of the lid being lodged in the slots with the lid in place to close the container.

10 Claims, 5 Drawing Figures

FIG. 3
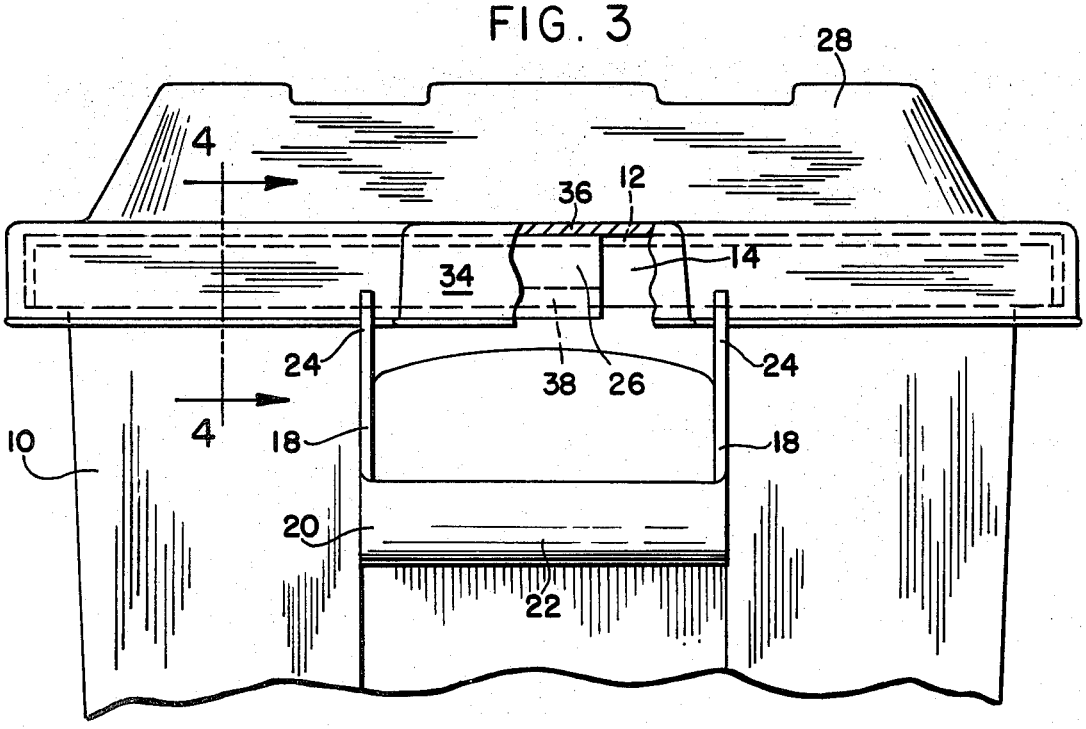
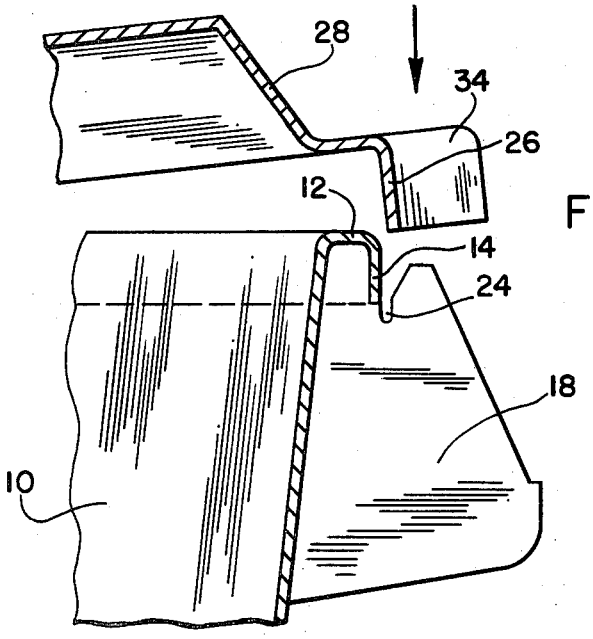
FIG. 4
FIG. 5
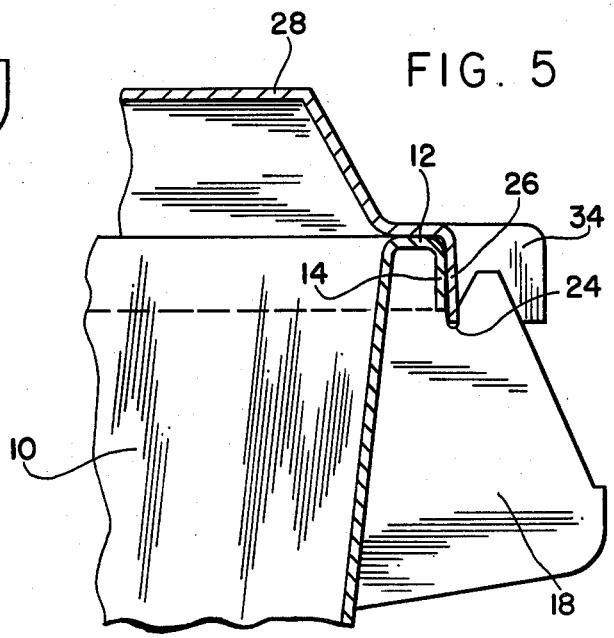

HANDLE INTERLOCK FOR A TRASH CAN LID

BACKGROUND OF THE DISCLOSURE

The problem of locking lids to receptacles such as trash cans is important and includes making a good solid lock which will not allow the lid to fall off or spring open when the receptacle is roughly treated or knocked over. At the same time, the lock should be easily effected and released, having due regard to costs. This invention provides a relatively simple and inexpensive solution, wherein the locking structure includes a double lock.

SUMMARY OF THE INVENTION

As an example of this invention, a trash can or the like of plastic, has an outstanding downturned rim spaced from the inner edge of the can periphery, forming a generally U-shaped rim that opens downwardly. At diametrically opposite areas, the can has handle structures, each of which comprises a spaced pair of parallel generally triangular vertical walls. These walls have narrow slotted top portions and wider lower portions, the latter being connected by rounded handle grip members that are spaced from the side wall of the trash can and provide easily grasped, comfortable grips with which to move the can, with or without its lid. The slots are open top and extend downwardly.

The lid has an outstanding downturned rim that covers the rim on the can when in place; and at diametrically opposed areas, outstanding, bottom opening U-shaped portions that fit between the above described handle walls while the slots in the walls receive the outer leg of the rim on the lid, regidifying the top rim of the can and forming an interlock. The inverted U-shaped portions of the rim of the lid may include rearwardly extending horizontal tabs or lips that lie under the edge of the outer leg of the rim on the can when the U-shaped portions of the lid rim are in locked condition relative to the can lid, to provide a releasable latch.

This construction forms a relatively tight, simple interlock for the lid on the can which is not easily disrupted but is easily manually released.

BRIEF DESCRIPTION OF THE DRAWINGS

FIG. 3 is a view in end elevation, partly in section;

FIG. 4 is a sectional view taken on line 4—4 of FIG. 3 but showing the lid raised from the container; and FIG. 5 is a similar view showing the lid closed.

PREFERRED EMBODIMENT OF THE INVENTION

Figure 1:
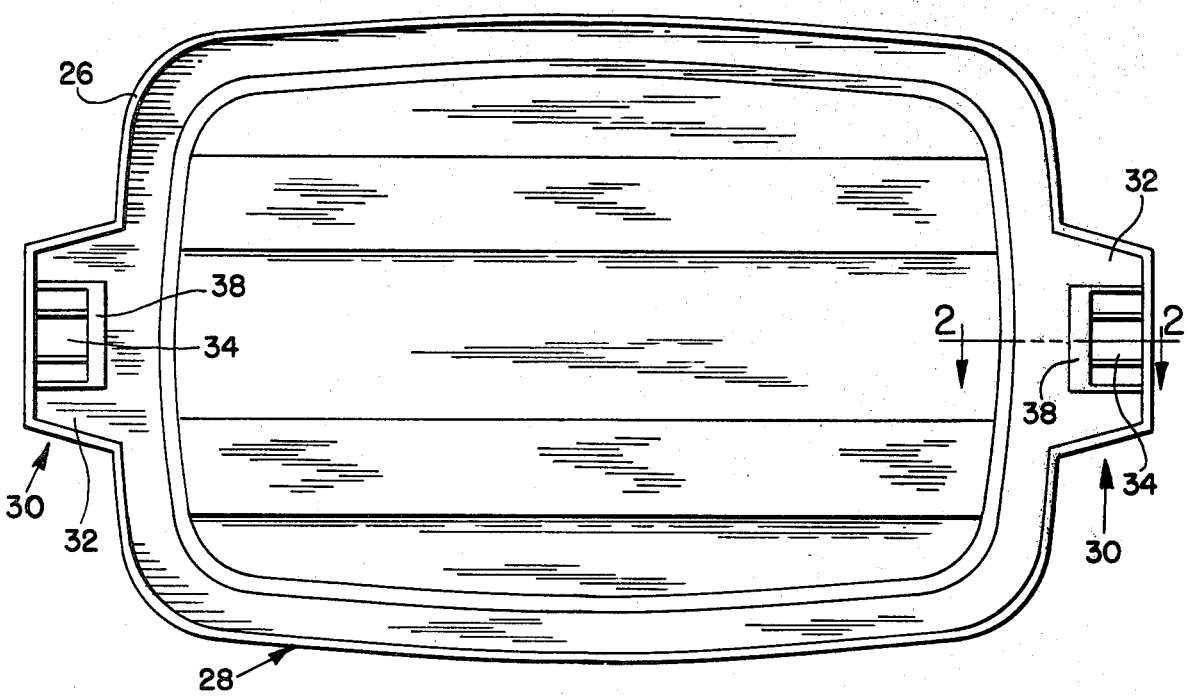
FIG. 1 is a bottom plan view of the lid.
Figure 2:
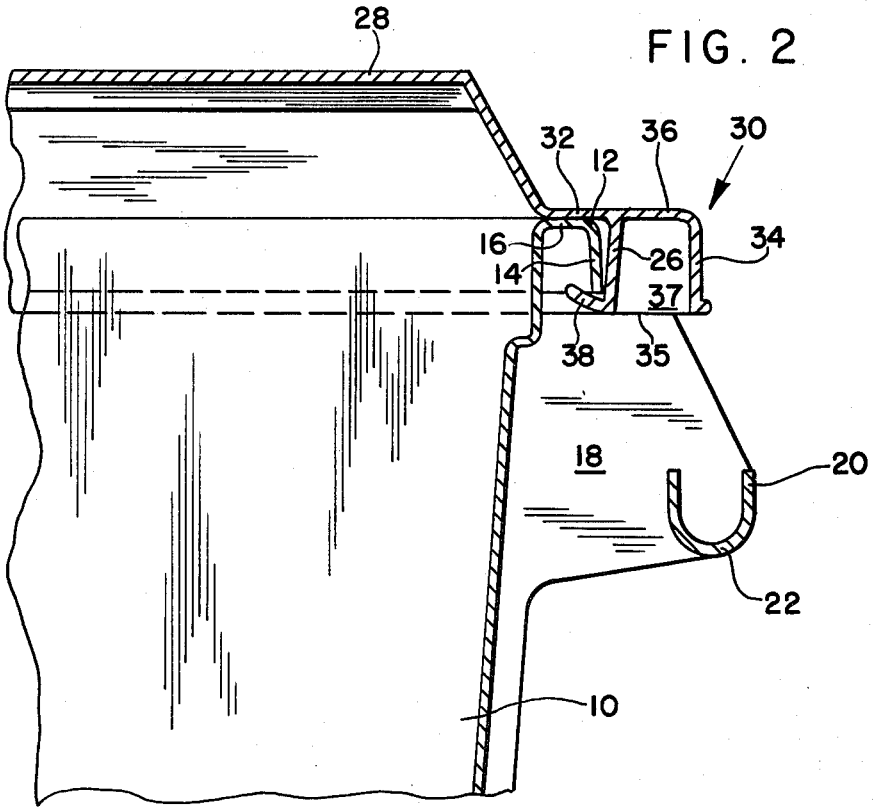
FIG. 2 is a section on line 2—2 of FIG. 1, and also showint the container.

An open top receptacle 10 has an outstanding rim 12 of inverted U-shape which includes a downwardly extending slightly outwardly slanting leg 14 and a closed bottom 16. At diametrically spaced points, a pair of parallel outstanding triangular walls or fins 18 are located. This structure appears at diametrically opposite areas. Connecting each pair of these walls of fins, at their lower, wider areas, is a handle 20 which includes a rounded channel or U-shaped portion 22 serving as a hand grip and being outwardly spaced from the wall of the receptacle to allow the hand of the user to obtain a good grip to lift or move the can. At their upper, narrower areas, each wall or fin has an upwardly open downwardly extending slot 24. These slots receive and rigidify the downturned rim 26 of the lid 28 in closed condition of the containeer, and with the releasable latch, this structure forms the interlock preventing accidental release.

In the space between each pair of the walls or fins 18 there is a locking member 30 radially outwardly extending in the form of an inverted "U" spaced from the lid itself as at 32 by a distance to span the rim 14, 16 on the container. Each locking member 30 includes an outer rim 34, and a closed bottom 36, and midway of the length of the locking member there is an open bottom box 35 with an inner wall 36, the latter having an upwardly slanting inwardly directed tab or lip 38 that easily snaps under the lower free edge of the outwardly slanting leg 14 of the rim 12 when the lid is applied. This tab or lip is sufficient to hold the lid in closed condition of the container even if it is roughly treated or knocked over. The leg 14 slants out as it extends down, and causes the lip 38 and wall 26 to be bent outwards as the lid is applied, and to snap back to locked position. To release the lid, it is merely necessary to bend upwards on the inverted U 30 with the fingers, to release lip 38 from the leg 14 of the rim 12. It should be noted that the lip 30 is shorter than the distance between the walls 18, and does not interfere therewith. Also, the lock members 30 are not handles to lift the container.

In the present case, the container and lid are shaped in such a way, FIG. 1, that the lid can be applied only in two positions in each of which the lock on the lid is located between the walls or fins 18.

Referring to FIG. 4, the lid is about to be applied to the container in one of the two possible orientations thereof. As the lid is moved down, see the arrow, the edge of the rim 26 is guided into the slots 24 by the leg 14 of its rim 12, and the latch structure 34 is located between walls 18, see FIG. 5.

I claim:

1. A plastic locking lid for a plastic open top container having a peripheral rim with a downturned edge thereon, spaced from the periphery thereof, forming an inverted U-shaped channel at the edge of the container top, said lid having a peripheral rim including an outwardly extending portion and a peripheral downwardly extending portion at its edge, the downwardly extending lid rim portion encompassing the U-shaped edge channel of the container with the lid applied to the container, a latch releaseably locking the lid to the container at the downturned edge thereof, an outstanding handle on the container, a pair of upright circumferentially spaced walls on the container encompassing the handle, and a vertical slot at the top portion of each wall, the downwardly extending lid rim portion being engaged in the slots when the lid is locked to the container.

2. The plastic locking lid of claim 1 including a second handle and slotted wall construction at a diametrically opposite position on the container.

3. The lid of claim 1 wherein the outstanding handle is below the rim of the container and the locking structure.

4. The lid of claim 4 wherein the handle is located outwardly of the locking structure.

5. An interlock for an open top plastic container and a lid therefor wherein the lid has a downturned rim and a latch element thereon, a pair of outstanding vertical generally parallel spaced walls on the container adjacent its open top, a handle between the walls and attached thereto at the lower edges thereof spaced from the adjacent wall of the container, an open top downwardly extending slot in each wall at the upper edges thereof, the rim of the lid being received in said slots with the lid in place closing the container, and means on the container between the walls cooperating with the latch element on the rim of the lid to latch the lid to the container.

6. The interlock of claim 5 wherein said means includes a portion of a downturned rim on the container at the edge of the open top thereof.

7. The interlock of claim 6 wherein the edge of the lid and the edge of the open top of the container are non-circular and fit together in only a predetermined orientation in which the latch element cooperates with the rim on the container that lies between the walls.

8. The interlock of claim 5 wherein the walls are generally triangular, the slots being at apeces thereof.

9. The interlock of claim 6 wherein the rim of the lid fits over the rim on the container.

10. The interlock of claim 9 wherein the slots have inner edges aligned with the outer edge surface of the rim on the container, so that the rim on the lid is guided by the rim on the container into said slots.

* * * * *